US010399372B2

(12) United States Patent
Kanai

(10) Patent No.: US 10,399,372 B2
(45) Date of Patent: Sep. 3, 2019

(54) TEST PATTERN CREATION METHOD, TEST PATTERN, PRINTING APPARATUS, AND PROGRAM

(71) Applicant: SEIKO EPSON CORPORATION, Tokyo (JP)

(72) Inventor: Masashi Kanai, Azumino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 4 days.

(21) Appl. No.: 15/899,773

(22) Filed: Feb. 20, 2018

(65) Prior Publication Data

US 2018/0236799 A1 Aug. 23, 2018

(30) Foreign Application Priority Data

Feb. 21, 2017 (JP) ..... 2017-029922

(51) Int. Cl.

| | |
|---|---|
| ***B41J 29/393*** | (2006.01) |
| ***B41J 2/045*** | (2006.01) |
| ***B41J 2/155*** | (2006.01) |
| ***B41J 2/21*** | (2006.01) |
| ***B41J 2/14*** | (2006.01) |
| ***B41J 19/14*** | (2006.01) |

(52) U.S. Cl.

CPC ..... *B41J 29/393* (2013.01); *B41J 2/04505* (2013.01); *B41J 2/04586* (2013.01); *B41J 2/1433* (2013.01); *B41J 2/155* (2013.01); *B41J 2/2103* (2013.01); *B41J 2/2135* (2013.01); *B41J 19/145* (2013.01); *B41J 2029/3935* (2013.01)

(58) Field of Classification Search

CPC .. B41J 2/04505; B41J 2/04586; B41J 2/1433; B41J 2/155; B41J 2/2103; B41J 2/04503; B41J 2/2135; B41J 2/04558; B41J 19/141; B41J 19/142; B41J 19/145; B41J 25/001

See application file for complete search history.

(56) References Cited

U.S. PATENT DOCUMENTS

| | | | | |
|---|---|---|---|---|
| 6,527,359 | B1 | 3/2003 | Otsuki | |
| 8,845,068 | B2 | 9/2014 | Kammerzell | |
| 9,248,679 | B1 * | 2/2016 | Aoi | 347/19 |
| 2007/0008370 | A1 | 1/2007 | Kawatoko et al. | |
| 2007/0064077 | A1 * | 5/2007 | Konno | 347/102 |
| 2009/0231374 | A1 | 9/2009 | Van De Wynckel et al. | |

(Continued)

FOREIGN PATENT DOCUMENTS

| | | |
|---|---|---|
| EP | 2 062 734 A1 | 5/2009 |
| JP | 2007-015269 A | 1/2007 |

OTHER PUBLICATIONS

Extended European Search Report dated Jul. 19, 2018 in related European Appl. 18157945.9 (7 pgs.).

*Primary Examiner* — Juanita D Jackson

(74) *Attorney, Agent, or Firm* — Foley & Lardner LLP

(57) ABSTRACT

A method of creating a test pattern including a plurality of ruled lines for measuring an impact displacement in a main scanning direction includes creating the test pattern such that the test pattern includes at least three parts arranged in a sub-scanning direction of the printing apparatus, the at least three parts being selected from parts for measuring an impact displacement due to head displacement, chip displacement, round-trip displacement, column displacement, and/or position displacement.

10 Claims, 14 Drawing Sheets

(56) References Cited

U.S. PATENT DOCUMENTS

| | | | | |
|---|---|---|---|---|
| 2012/0033006 | A1* | 2/2012 | Murayama et al. | 347/14 |
| 2013/0286075 | A1 | 10/2013 | Tamiya et al. | |
| 2015/0273857 | A1* | 10/2015 | Derleth et al. | 347/19 |

* cited by examiner

TEST PATTERN CREATION METHOD, TEST PATTERN, PRINTING APPARATUS, AND PROGRAM

CROSS-REFERENCE TO RELATED APPLICATIONS

The present application claims priority to Japanese Patent Application No. 2017-029922, filed on Feb. 21, 2017, the contents of which are hereby incorporated by reference in their entirety.

BACKGROUND

1. Technical Field

The present disclosure relates to test patterns for printing.

2. Related Art

JP-A-2007-15269 discloses detecting the inclination of a recording head and the displacement of the recording head between a forward pass and a reverse pass. The inclination is displacement in position due to rotation about a direction perpendicular to the main scanning direction and the sub-scanning direction.

SUMMARY

Impact displacement in printing is caused by factors other than those described above and, hence, there remained room for improvement. In view of the above problem, an advantage of some aspects described in the present application is to allow creation of a test pattern that enables measurement of an impact displacement of new combinations of factors that cause impact displacement, or to allow creation of a test pattern that enables measurement of at least three types of impact displacement.

According to an aspect of the present disclosure, a method of creating a test pattern including a plurality of ruled lines for measuring an impact displacement in a main scanning direction includes: providing a printing apparatus that includes a first print head ejecting ink of a first ink color and a second print head ejecting ink of a second ink color. The first print head includes first and second print chips. The first print chip includes a plurality of nozzles forming a first nozzle column arranged in an intersecting direction intersecting with the main scanning direction and a second nozzle column located on a predetermined side of the first nozzle column in the main scanning direction. The test pattern is created in such a manner as to include at least three of a part for measuring an impact displacement caused by head displacement of the first print head and the second print head, a part for measuring an impact displacement caused by chip displacement of the first print chip and the second print chip, a part for measuring an impact displacement caused by round-trip displacement including forward-pass and reverse-pass displacement in main scanning, a part for measuring an impact displacement caused by column displacement of the first nozzle column and the second nozzle column, a part for measuring an impact displacement caused by position displacement of the first print head with respect to a direction of rotation about the main scanning direction, and a part for measuring an impact displacement caused by position displacement of the first print head with respect to the direction of rotation about a direction orthogonal to the main scanning direction and the intersecting direction. A length, in a sub-scanning direction, of the test pattern corresponding to the printing apparatus is less than or equal to a length of the head in the sub-scanning direction, and the at least three parts are arranged in the sub-scanning direction. According to the aspect, a test pattern allowing measurement of at least three types among the six types of displacement described above can be created.

In one aspect, the second print head includes a third print chip, the third print chip includes a plurality of nozzles forming a third nozzle column arranged in the intersecting direction and a fourth nozzle column located on the predetermined side of the third nozzle column in the main scanning direction; a range in the intersecting direction, in which dots can be formed by the first nozzle column, is at least partially superposed with a range in the intersecting direction in which dots can be formed by the third nozzle column; and a part for measuring an impact displacement due to head displacement of the first print head and the second print head is created using the first nozzle and the third nozzle by main scans in the same direction. According to this configuration, a part for measuring the displacement of the first print head and the second print head can be created by a single main scan.

In one aspect, the second print chip includes a plurality of nozzles forming the first and second nozzle columns, and a part for measuring an impact displacement due to chip displacement of the first print chip and the second print chip is created using a range in which dot formation is possible through main scans in the same direction with respect to the intersecting direction in the first nozzle column included in the first print chip and the second print chip. According to this configuration, a part for measuring the displacement of the first print chip and the second print chip can be created by a single main scan.

In one aspect, a part for measuring an impact displacement due to column displacement of the first nozzle column and the second nozzle column is created using the first nozzle column and the second nozzle column of the first print chip by main scans in the same direction. According to this configuration, a part for measuring the displacement of the first nozzle column and the second nozzle column can be created by a single main scan.

In one aspect, a part for measuring an impact displacement due to round-trip displacement corresponding to a forward pass and a reverse pass of main scanning is created using the first nozzle of the first print chip by main scanning of a forward pass and a reverse pass using the first nozzle of the first print chip. According to this configuration, a part for measuring the displacement of the first nozzle column and the second nozzle column can be created by two main scans.

In one aspect, as a part for measuring an impact displacement due to position displacement in a direction of rotation about a direction orthogonal to the main scanning direction of the first print head and the intersecting direction, a part for measuring a displacement of a forward pass and a reverse pass in main scanning is created at each of two different locations in the intersecting direction. According to this configuration, a part for measuring the position displacement in a direction of rotation about a direction orthogonal to the main scanning direction of the first print head can play the role of a part for measuring the displacement of the forward pass and reverse pass of the main scan.

In one aspect, as a part for measuring an impact displacement due to position displacement in a direction of rotation about the main scanning direction, a part for measuring an impact displacement due to round-trip displacement of the forward and reverse main scanning may be created at each of two different locations in the intersecting direction. According to this configuration, a part for measuring an impact displacement due to position displacement in a direction of rotation about the main scanning direction, can play the role of a part for measuring an impact displacement due to position displacement in a direction of rotation about a direction orthogonal to the main scanning direction of the first print head and the intersecting direction.

In the above aspect, the test pattern may be created by less than or equal to two of the main scans. According to this aspect, a test pattern can be created in a short time.

The present disclosure can be realized in various manners other than those described above. For example, the present disclosure can be realized in the forms of the above-described test pattern, a printing apparatus implementing the above-described creation methods, a program realizing the above-described methods, a non-transitory storage medium storing this program, and the like.

BRIEF DESCRIPTION OF THE DRAWINGS

The invention will be described with reference to the accompanying drawings, wherein like numbers reference like elements.

DETAILED DESCRIPTION

Figure 1:
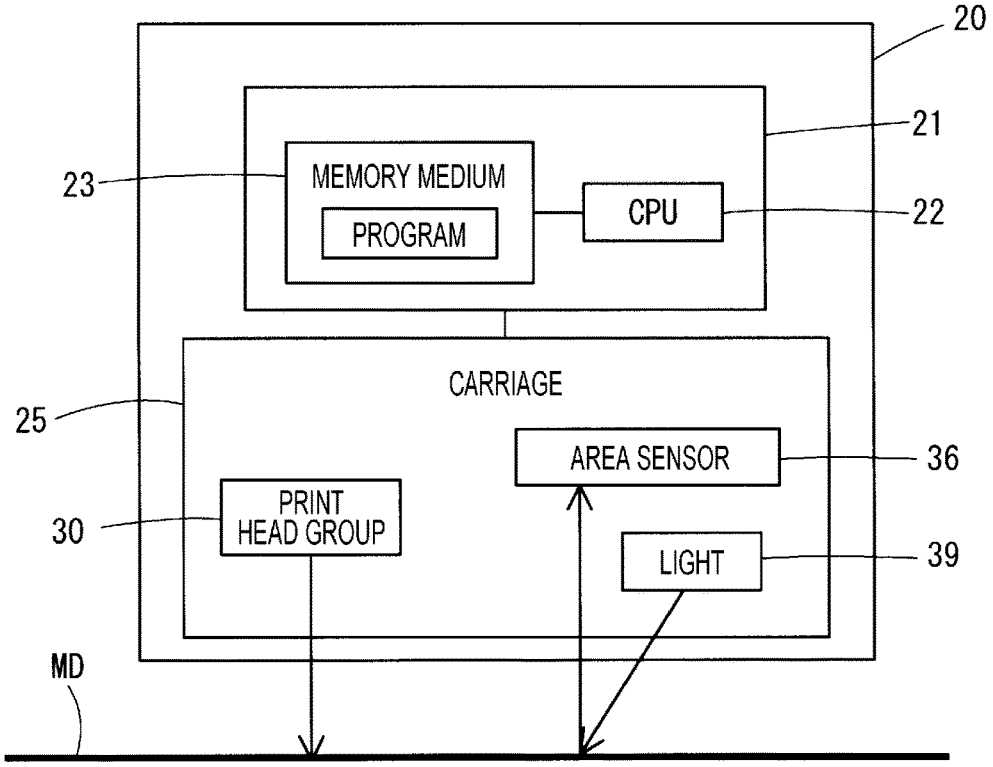
FIG. 1 is a functional block diagram of a printing apparatus.

FIG. 1 is a functional block diagram of a printing apparatus 20. The printing apparatus 20 includes a control unit 21 and a carriage 25. The control unit 21 includes a CPU 22 and a memory medium 23. The carriage 25 includes a print head group 30, an area sensor 36, and a light 39.

The printing apparatus 20 forms dots on a print medium MD by ejecting ink toward the print medium MD. The printing apparatus 20 ejects ink of six colors. The six colors are CMYKLcLm, that is, cyan, magenta, yellow, black, light cyan, and light magenta. In order to form dots, the printing apparatus 20 causes the carriage 25 to perform scans in the main scanning direction and transports the print medium MD in the sub-scanning direction. The main scanning direction intersects with the sub-scanning direction and, more specifically, is orthogonal to the sub-scanning direction.

The area sensor 36 measures the luminance value on the print medium MD. The light 39 radiates light toward a measurement area of the area sensor 36. The measurement performed by the area sensor 36 is used for processing for measuring the amount of impact displacement, as described below.

The dot formation and the measurement of the luminance value described above are controlled by the CPU 22. The memory medium 23 stores a program for realizing print processing, as described below. The print processing is processing for dot formation and luminance value measurement, as described above.

Figure 2:
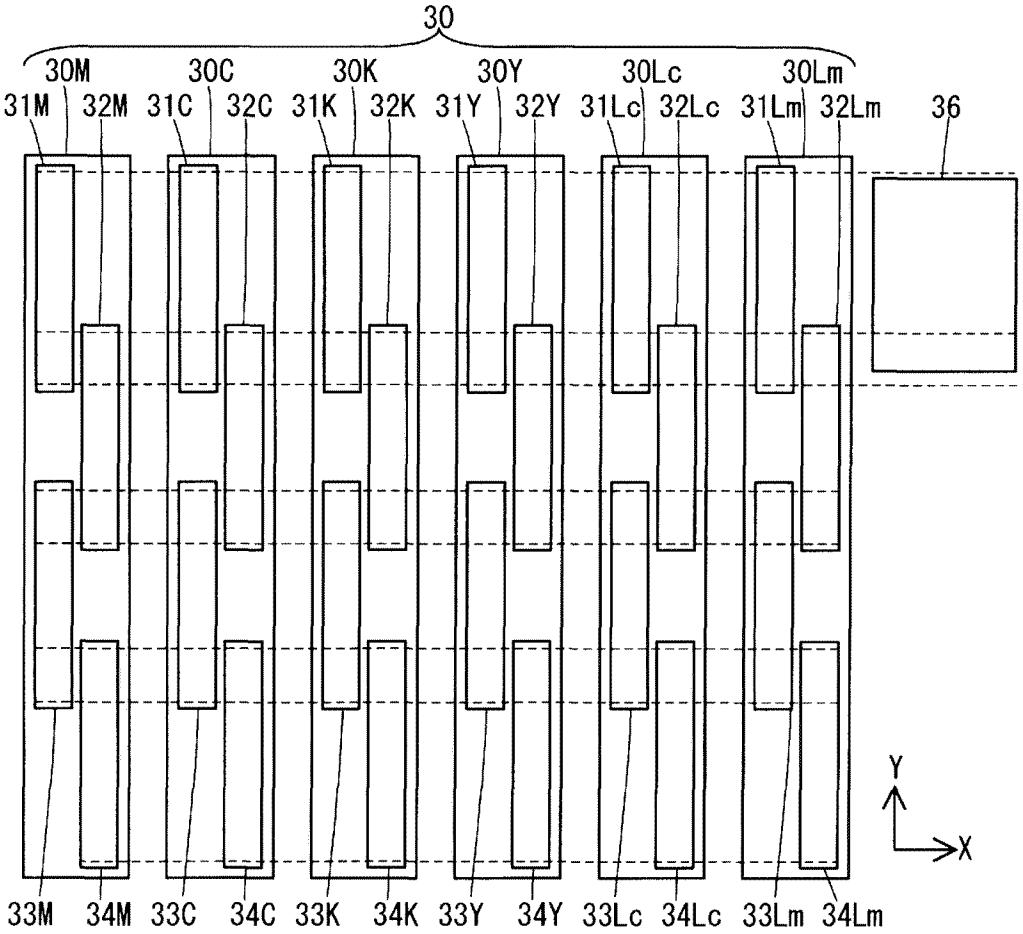
FIG. 2 is a diagram illustrating a print head group.

FIG. 2 illustrates the print head group 30. An X-Y coordinate system is illustrated in FIG. 2. The X direction indicates the main scanning direction. Main scanning in the positive X direction is also called forward-pass main scanning. Main scanning in the negative X direction is also called reverse-pass main scanning.

The Y direction indicates the sub-scanning direction. The downstream side of sub-scanning is the positive side in the Y direction. The print medium MD is transported from the lower side to the upper side in FIG. 2.

The print head group 30 is formed of a magenta print head 30M, a cyan print head 30C, a black print head 30K, a yellow print head 30Y, a light-cyan print head 30Lc, and a light-magenta print head 30Lm.

Hereinafter, the magenta print head 30M will be described as an example. The description below is the same for all the print heads except for difference in color. The magenta print head 30M includes a first print chip 31M to a fourth print chip 34M.

Figure 3:
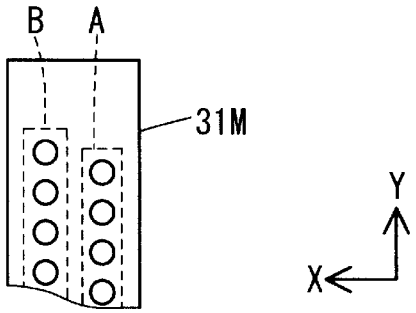
FIG. 3 is a diagram illustrating a first print chip viewed from a print medium side.

FIG. 3 illustrates the first print chip 31M viewed from the print medium MD side. A plurality of nozzles NZ are provided on the first print chip 31M. Ink drops are ejected from the nozzles NZ.

The nozzles NZ are arranged in two columns as illustrated in FIG. 3. Among the columns formed by the nozzles, a first located on the negative-X-direction side is called a nozzle column A and a second located on the positive-X-direction side is called a nozzle column B. Nozzles are also provided on the second print chip 32M to the fourth print chip 34M, similarly to the first print chip 31M.

The first print chip 31M to the fourth print chip 34M each include one or more superposed regions. The superposed region is a region where dots can be formed by either of the two print chips mounted in the same print head. The second print chip 32M has superposed regions respectively superposed with the first print chip 31M and the third print chip 33M. The third print chip 33M has a superposed region superposed with the fourth print chip 34M.

Hereinafter, a region which is not a superposed region is called a non-superposed region. In FIG. 2, a boundary between a superposed region and a non-superposed region is shown as a broken line.

Figure 4:
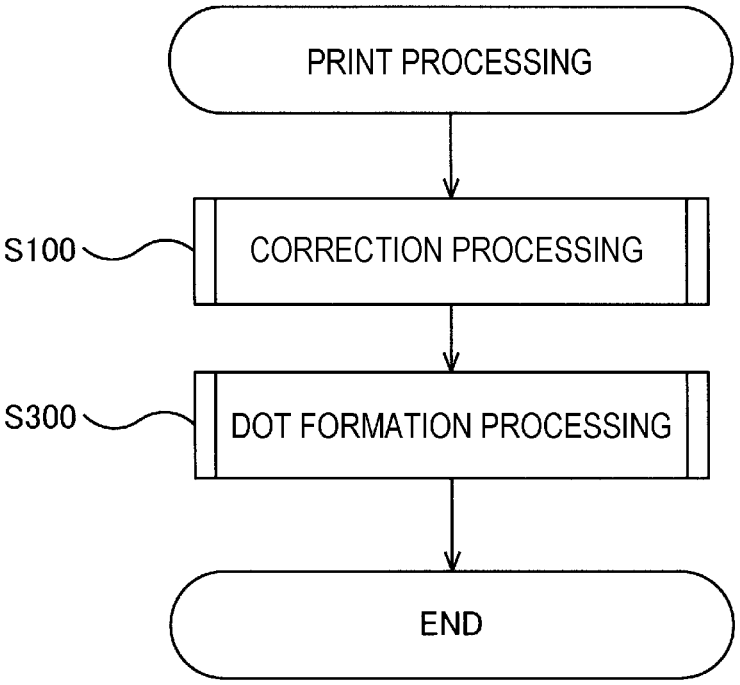
FIG. 4 is a flowchart illustrating print processing.

FIG. 4 is a flowchart illustrating print processing. When print processing is started, correction processing (step S100) is performed.

Figure 5:
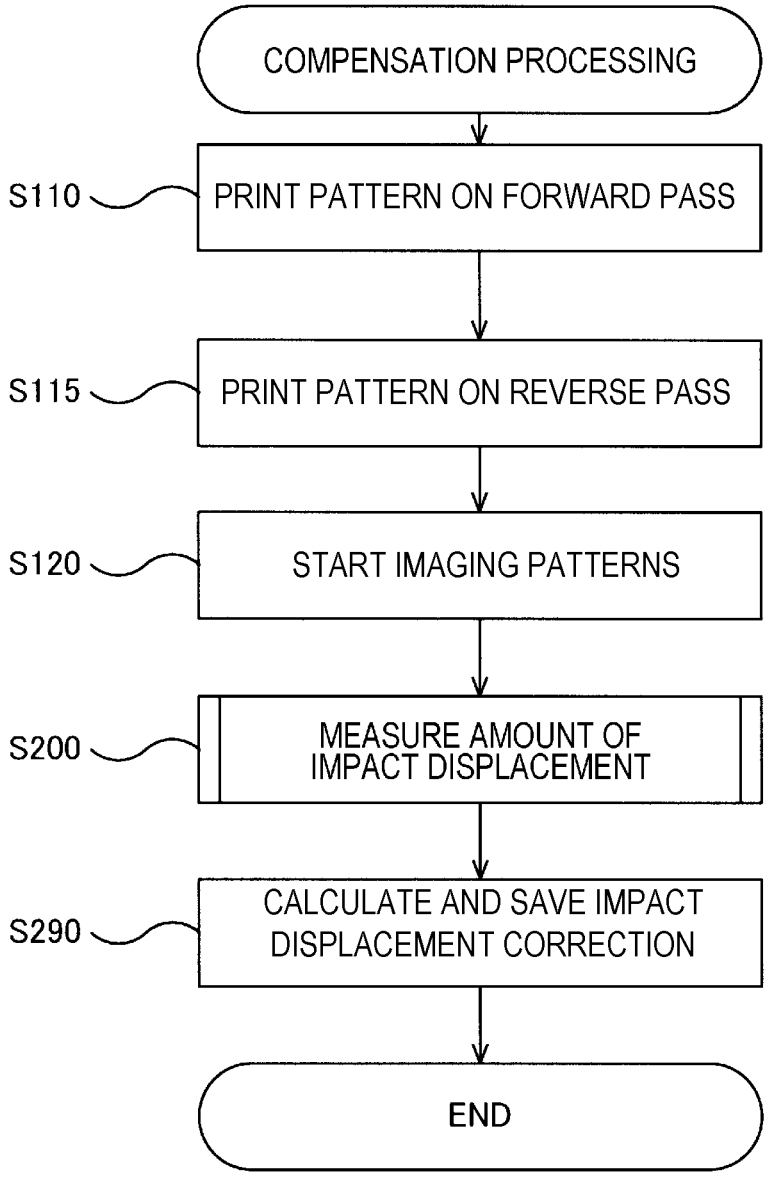
FIG. 5 is a flowchart illustrating correction processing.

FIG. 5 is a flowchart illustrating the correction processing. First, part of a test pattern 40 is printed on the print medium MD during the forward-pass main scanning (step S110), and then part of the test pattern 40 is printed during the reverse-pass main scanning (step S115). The whole of the test pattern 40 is created by steps S110 and S115.

Figure 6:
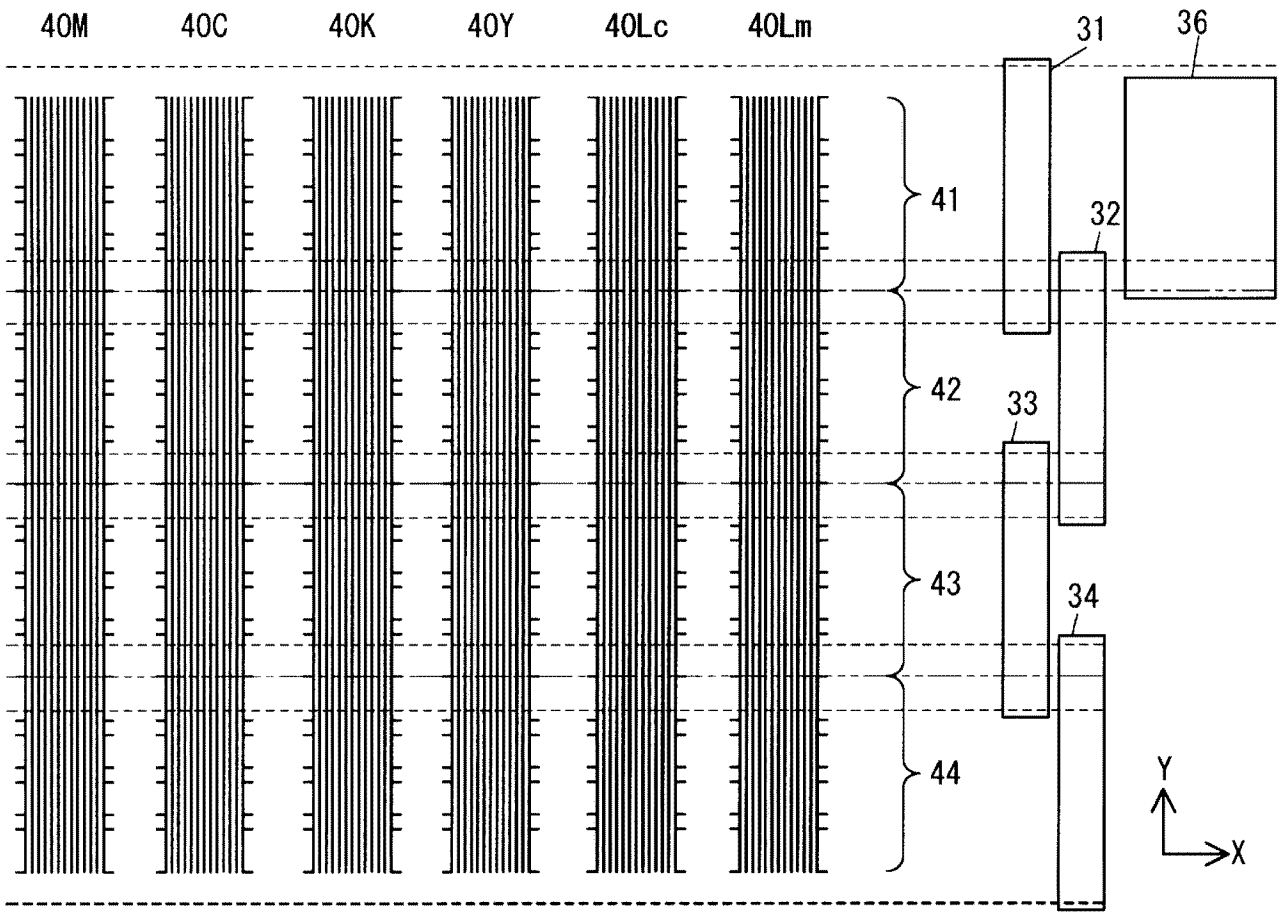
FIG. 6 is a diagram illustrating a test pattern.

FIG. 6 illustrates the test pattern 40. To illustrate a positional relationship with respect to the test pattern 40 in the Y direction, first to fourth print chips 31 to 34 and the area sensor 36 are also illustrated. The first print chip 31 is a name used in the case where the first print chip mounted on each of six heads is referred to without distinction. The same is true for the second to fourth print chips 32 to 34.

The length of the test pattern 40 in the sub-scanning direction of the printing apparatus 20 is less than or equal to the length of the print head group 30 in the sub-scanning direction. In more detail, in the test pattern 40, the length in the sub-scanning direction corresponding to the printing apparatus 20 is less than the length of the print head group 30 in the sub-scanning direction.

The test pattern 40 is formed of a magenta region 40M, a cyan region 40C, a black region 40K, a yellow region 40Y, a light cyan region 40Lc, and a light magenta region 40Lm. The regions are respectively formed at different positions in the X direction.

Each of the regions is divided into four regions in the Y direction. The four regions are a first region 41, a second region 42, a third region 43, and a fourth region 44 illustrated in FIG. 6. The boundary between the first region 41 and the second region 42 is near the center, in the Y direction, of a superposed region of the first print chip 31 and the second print chip 32. The boundary between the second region 42 and the third region 43 is near the center, in the Y direction, of a superposed region of the second print chip 32 and the third print chip 33. The boundary between the third region 43 and the third print chip 33 is near the center, in the Y direction, of a superposed region of the third print chip 33 and the fourth print chip 34.

The first region 41 is formed by ink ejected from a nozzle provided in the first print chip 31. Similarly, the second to fourth regions 42 to 44 are respectively formed by ink ejected from nozzles provided in the second to fourth print chips 32 to 34.

Next, imaging of the pattern is started (step S120). The imaging of the pattern is performed by a combination of the main scanning and the sub-scanning. The sub-scanning is performed such that each of the first to fourth regions 41 to 44 is included in the imaged range.

At each of the Y-direction positions, imaging of the six regions is performed using the main scanning. Hence, imaging is performed for 24 locations.

As soon as the imaging of the pattern is started and the imaging of the first location is finished, measurement of the amount of impact displacement is started in parallel with the imaging of other regions (step S200).

Figure 7:
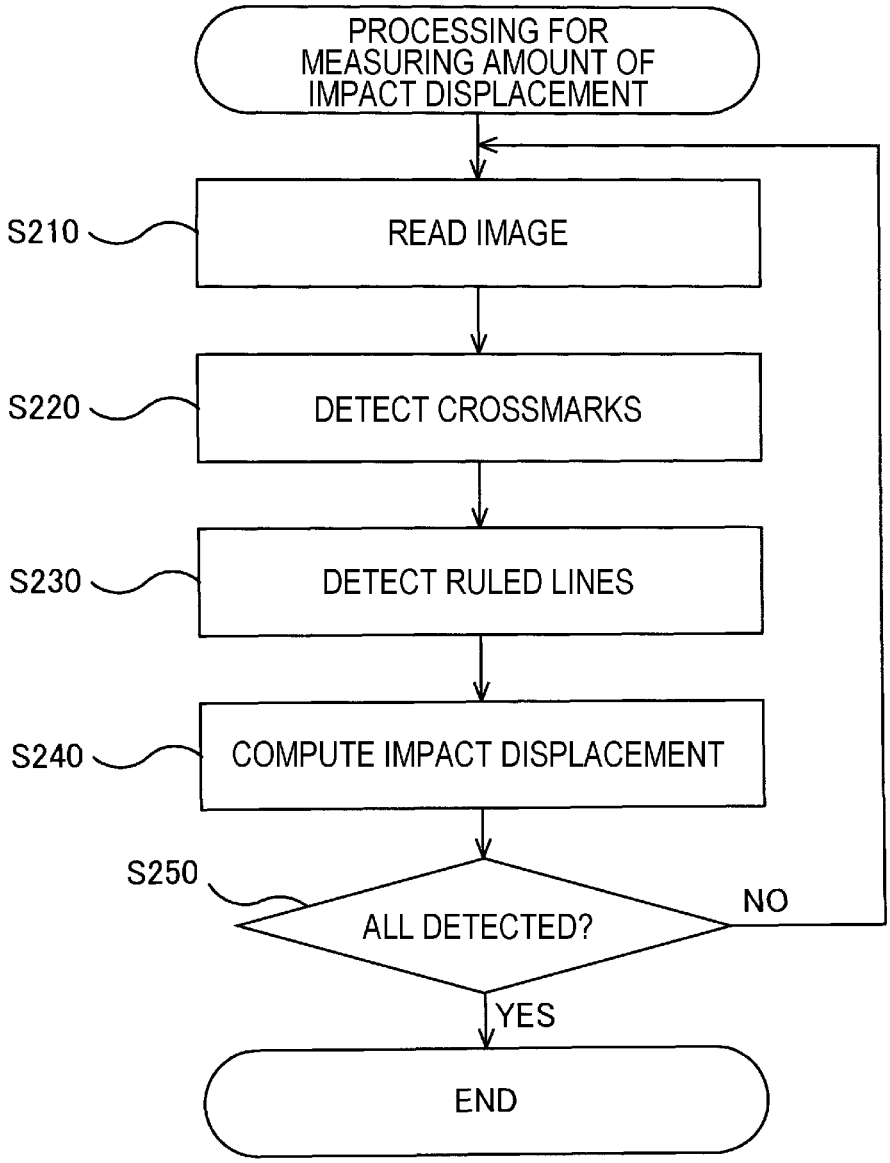
FIG. 7 is a flowchart of measuring the amount of impact displacement.

FIG. 7 illustrates a flowchart of processing for measuring the amount of impact displacement. First, the imaged image is read (step S210). Then, crossmarks are detected (step S220). Hereinafter, the details of the test pattern 40 will be described, including the crossmarks.

Figure 8:
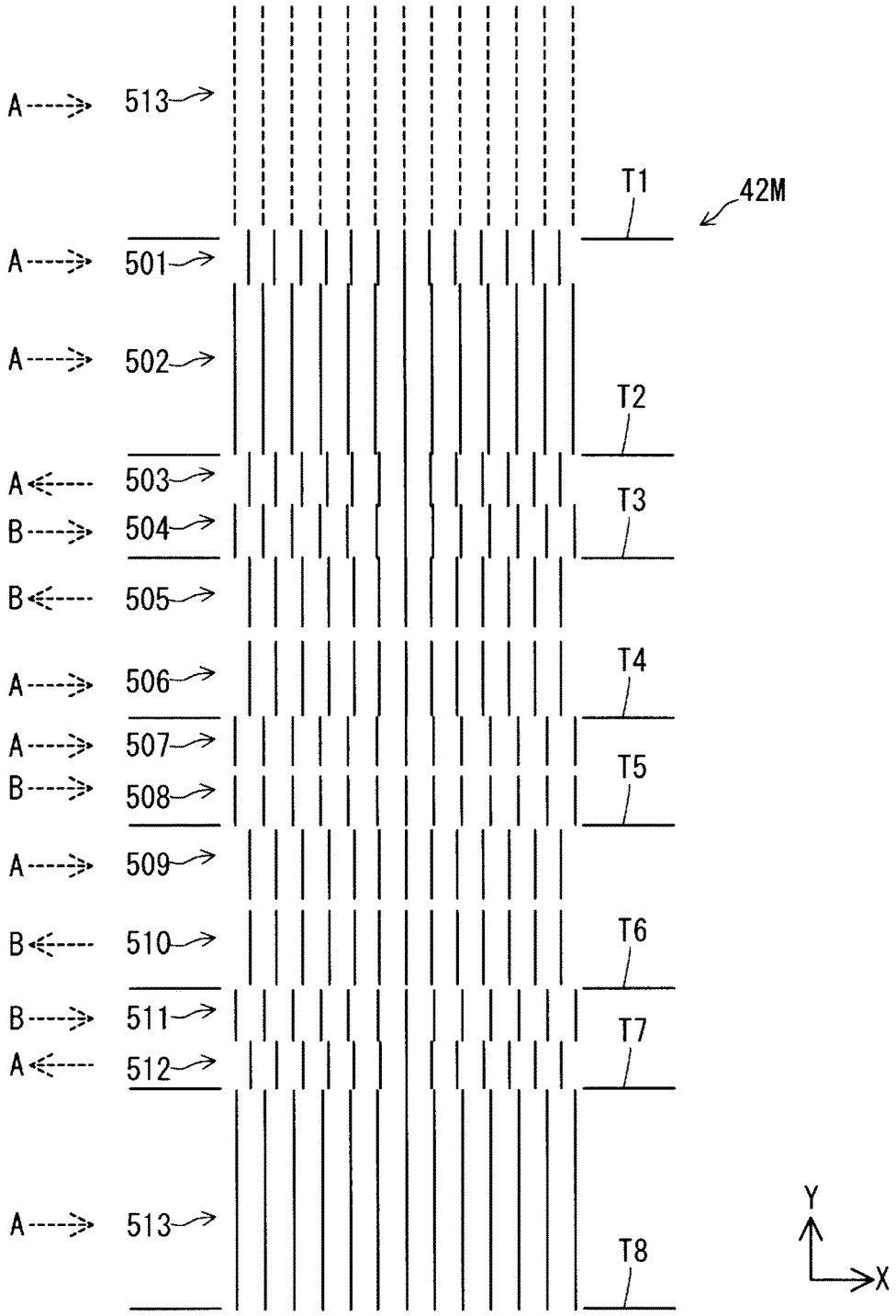
FIG. 8 is a diagram illustrating a second region of a magenta region.

FIG. 8 illustrates a region 42M as a representative of regions at 24 locations. The region 42M is the second region 42 of a magenta region 40M. Other regions are also the same as the region 42M, except for the ink color, with respect to the content not specifically described. The region 42M is formed of a first part 501 to a thirteenth part 513, and a plurality of crossmarks. Each of the first part 501 to the thirteenth part 513 is formed of 13 ruled lines. The ruled lines are formed as lines parallel to one another in the Y direction if roll or yaw described below has not been generated. The first part 501 to the thirteenth part 513 are arranged in the sub-scanning direction.

Note that the thirteenth part 513 includes one illustrated using solid lines and another illustrated using broken lines. The one included in the region 42M is illustrated using solid lines. One illustrated using broken lines is included in a region 41M (the first region 41 of a magenta region 40M). The thirteenth part 513 included in the region 41M is shown to explain the measurement of an impact displacement. The thirteenth part 513 included in the region 41M is also formed of solid lines.

As described before, the region 42M is formed by the second print chip 32M. The second print chip 32M includes the nozzle column A and the nozzle column B. The region 42M is formed by two passes.

Among the two passes, a pass formed on the forward pass includes the first part 501, a second part 502, a fourth part 504, a sixth part 506, a seventh part 507, an eighth part 508, a ninth part 509, an eleventh part 511, and a thirteenth part 513.

Among the two passes, a pass formed on the reverse pass includes a third part 503, a fifth part 505, a tenth part 510, and a twelfth part 512.

Parts formed by the nozzle column A include the first part 501, the second part 502, the third part 503, the sixth part 506, the seventh part 507, the ninth part 509, the twelfth part 512, and the thirteenth part 513.

Parts formed by the nozzle column B include the fourth part 504, the fifth part 505, the eighth part 508, the tenth part 510, and the eleventh part 511.

The first part 501 to the sixth part 506, and the eighth part 508 to the thirteenth part 513 are formed by the first print chip 31 provided at a head that is the target to be measured in terms of impact displacement. In the case of the region 42M, the magenta print head 30M is the head that is the target to be measured in terms of impact displacement. On the other hand, the seventh part 507 is formed by the first print chip 31 provided on the reference head. In the case of the present embodiment, the reference head is the cyan print head 30C.

In FIG. 8, a distinction between a forward pass and a reverse pass described above is illustrated using arrows. The right arrows represent forward passes. The left arrows represent reverse passes. Nozzle columns are represented by characters A and B.

Next, crossmarks will be described. Referring to FIG. 8, the region 42M includes crossmarks T1-T8. In FIG. 8, although reference symbols are not attached to crossmarks located on the negative X-direction side, a pair of two lines located at the same position in the Y direction form one crossmark (for example, crossmark T1).

The crossmark T1 indicates the boundary between the first part 501 of the region 42M and the thirteenth part 513 included in the region 41M. The crossmark T2 indicates the boundary between the second part 502 and the third part 503. The crossmark T3 indicates the boundary between the fourth part 504 and the fifth part 505. The crossmark T5 indicates the boundary between the eighth part 508 and the ninth part 509. The crossmark T6 indicates the boundary between the tenth part 510 and the eleventh part 511. The crossmark T7 indicates the boundary between the twelfth part 512 and the thirteenth part 513. The crossmark T8 indicates the boundary between the thirteenth part 513 and the first part 501 included in a region 43M (the third region 43 of the magenta region 40M).

In two parts neighboring each other with a crossmark therebetween, intervals between ruled lines are different from each other to allow the amount of impact displacement to be measured. FIG. 8 illustrates a state in which a difference is not generated. Hence, at rule lines at the centers of respective parts, the positions in the X direction are the same.

Detection of a crossmark in step S220 means that the positions, in the Y direction, of the crossmarks T1 to T7 are roughly determined. Note that the crossmark T8 is not a target in step S220. Note that the crossmark T8 in the region 42M plays the role of the crossmark T1 in the region 43M. Detection as the crossmark T8 is not performed in either of the regions.

The crossmarks may be formed using any ink color. In the present embodiment, the crossmarks are formed using black ink.

Next, the positions of the ruled lines are detected (step S230). The positions detected in step S230 are positions in the X direction.

Figure 9:
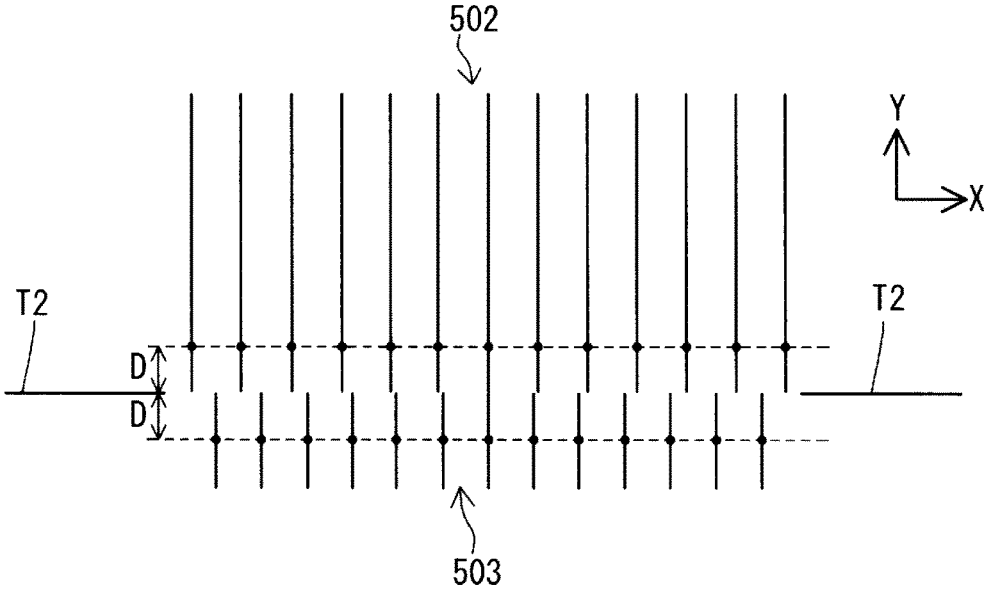
FIG. 9 is a diagram illustrating how the positions of ruled lines are detected.

FIG. 9 illustrates how the positions of the ruled lines are detected, taking the second part 502 and the third part 503 as examples. To execute step S230, the position of the crossmark T2 in the Y direction is utilized. In other words, the positions, in the X direction, of the ruled lines forming the respective parts are detected by detecting changes in luminance in the X direction at positions displaced by a predetermined length D from the crossmark T2 on the positive side and negative side in the Y direction. The position detected for a certain ruled line is hereinafter called a detected position of the ruled line. In FIG. 9, detected positions are illustrated as dots. The same is true for the case where the crossmarks T1, T3-T7 are used.

Here, measurement of an impact displacement by using the first part 501 to the thirteenth part 513 is described. By comparing the two sides of the crossmark T1, i.e., by comparing the ruled lines at the positions of the first part 501 of the region 42M and the thirteenth part 513 of the region 41M, a displacement between the first print chip 31M and the second print chip 32M (hereinafter called a chip displacement) can be measured. In other words, the method used to form both the first part 501 and the thirteenth part 513 is the same except that different print chips are used. Hence, when displacement is generated, it is determined that the displacement is caused by chip displacement.

Note that there are no ruled lines on the positive-Y-direction side of a crossmark T1 located within the first region 41. Hence, in the case of parts that belong to the first region 41, measurement using the crossmark T1 is not executed.

By comparing the positions of ruled lines on the two sides of the crossmark T2, that is, positions of ruled lines in the second part 502 and in the third part 503, the displacement between the forward pass and the reverse pass with respect to the nozzle column A (hereinafter, called round-trip displacement) can be measured. The reason for this is that the method used to form both the second part 502 and the third part 503 is the same except for difference between a forward pass and a reverse pass.

By comparing the positions of ruled lines on the two sides of the crossmark T3, that is, positions of the ruled lines in the fourth part 504 and in the fifth part 505, the displacement between the forward pass and the reverse pass with respect to the nozzle column B can be measured, similarly to the case of the nozzle column A using the two sides of the crossmark T2.

By comparing the positions of ruled lines on the two sides of the crossmark T4, that is, the positions of the ruled lines in the sixth part 506 and in the seventh part 507, the displacement between the print heads (hereinafter, called head displacement) can be measured. The reason for this is that the method used for forming both the sixth part 506 and the seventh part 507 is the same except that different print heads are used.

By comparing the positions of ruled lines on the two sides of the crossmark T5, that is, the positions of ruled line in the eighth part 508 and in the ninth part 509, the displacement between the nozzle column A and the nozzle column B (hereinafter, called column displacement) can be measured. The reason for this is that the method used to form both the eighth part 508 and the ninth part 509 is the same except for the difference in nozzle column.

By comparing the positions of ruled lines on the two sides of the crossmark T6, that is, the positions of ruled lines in the tenth part 510 and in the eleventh part 511, the displacement between the forward pass and the reverse pass with respect to the nozzle column B can be measured, similarly to the case of the crossmark T3.

By comparing the positions of ruled lines on the two sides of the crossmark T7, that is, the positions of ruled lines in the twelfth part 512 and in the thirteenth part 513, the displacement between the forward pass and the reverse pass with respect to the nozzle column A can be measured, similarly to the case of the crossmark T2.

Hereinafter, measurement of a displacement will be described with respect to other facts, including the fact that parts for measuring a round-trip displacement for the nozzle columns A and B are respectively provided at two locations.

The types of impact displacement to be measured using the test pattern 40 include at least the following two types, in addition to the types described above. The first one is the yaw of a print head. The second one is the roll of the print head. Both of them are types of displacement of the alignment of the print head.

Figure 10:
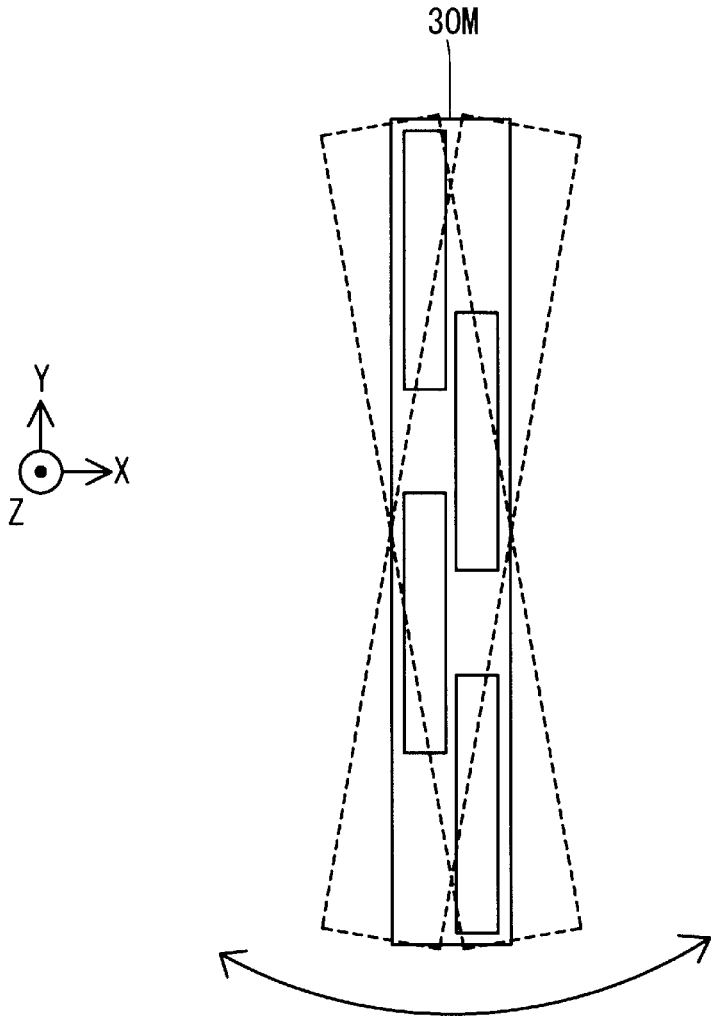
FIG. 10 is a diagram illustrating how a magenta print head is displaced in a yaw direction.

FIG. 10 illustrates how the magenta print head 30M is displaced in the yaw direction. Referring to FIG. 10, yaw means the displacement of alignment due to rotation about the Z-direction. The Z-direction is a direction orthogonal to the X-direction and Y-direction. In other words, the Z-direction is a direction orthogonal to the print surface of the print medium MD.

Figure 11:
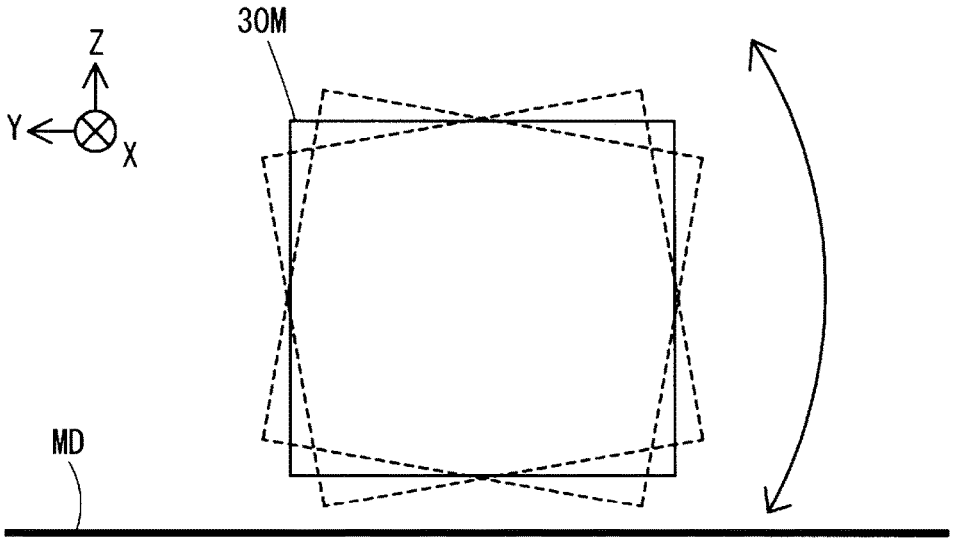
FIG. 11 is a diagram illustrating how the magenta print head is displaced in a roll direction.

FIG. 11 illustrates how the magenta print head 30M is displaced in the roll direction. Referring to FIG. 10, rolling means the displacement of alignment due to rotation about the X-direction.

Note that, with respect to pitch (displacement of alignment due to rotation about the Y-direction), because correction for impact displacement can be performed without an obstacle if the displacement is measured as head displacement using the two sides of the crossmark T4, pitch is not measured as an independent displacement amount in the present embodiment.

Hereinafter, round-trip displacement will be described before describing yaw and roll in detail.

Figure 12:
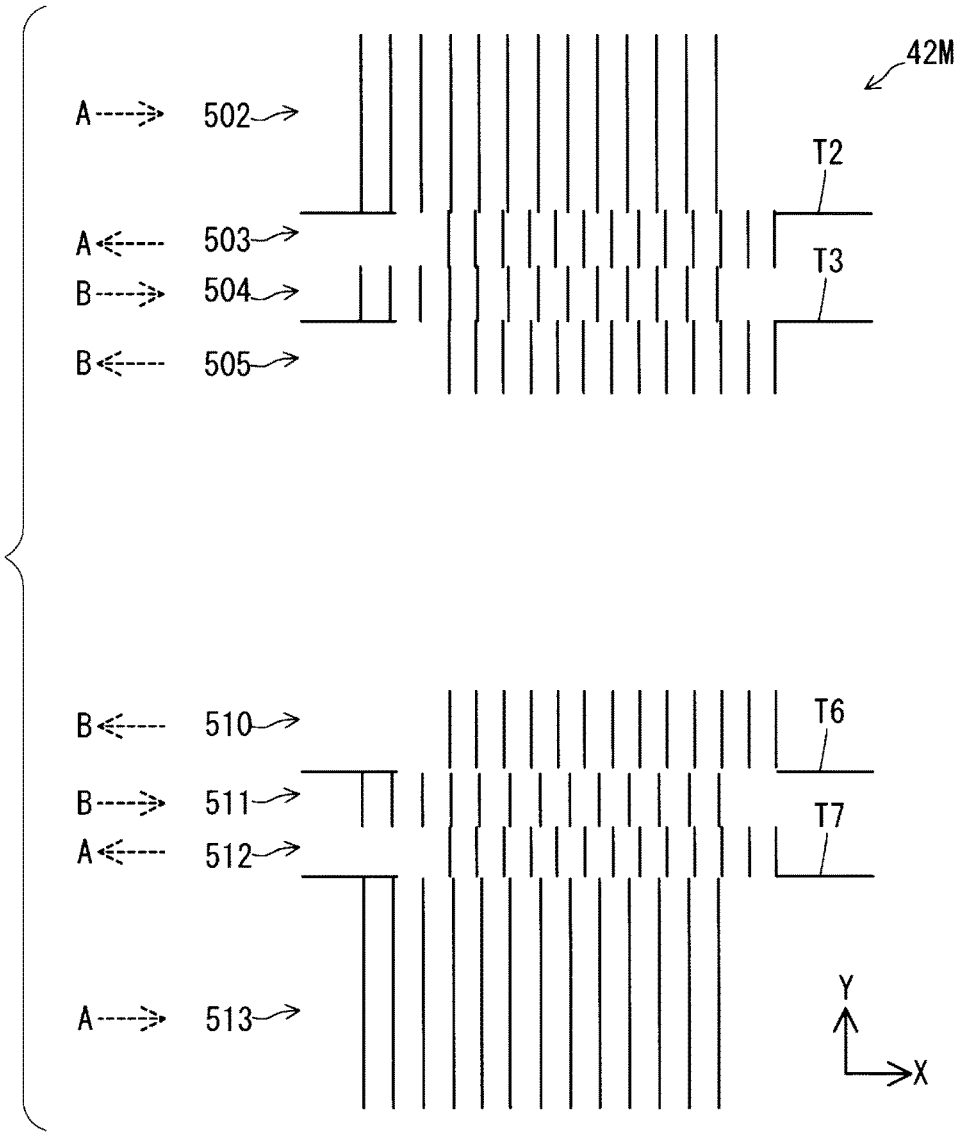
FIG. 12 is a diagram illustrating a test pattern created in the case where round-tip displacement is generated.

FIG. 12 illustrates the region 42M created in the case where round-tip displacement is generated. However, the first part 501, the sixth part 506, the seventh part 507, the eighth part 508, and the ninth part 509, which are not used for the measurement of a round-trip displacement, are omitted in FIG. 12. They are similarly omitted also in FIG. 13 and FIG. 14. It is assumed that displacement other than round-trip displacement is not generated in the second region 42 illustrated in FIG. 2. Further, although displacement of the position of the crossmark in the X-direction is also generated due to round-trip displacement, the position of the crossmark in the X-direction is not so important and, hence, it is assumed in the illustration of FIG. 12 that the position of the crossmark in the X-direction is not displaced.

As illustrated in FIG. 12, in the case where round-trip displacement is generated, displacement is not generated among parts themselves formed on the forward pass. Similarly, displacement is not generated among parts themselves formed on the reverse pass. On the other hand, displacement in the X-axis is generated between a part formed on the forward pass and a part formed on the reverse pass. Hence, round-trip displacement can be measured by using at least one of the both sides of the crossmarks T2 and T3 and the both sides of the crossmarks T6 and T7.

Figure 13:
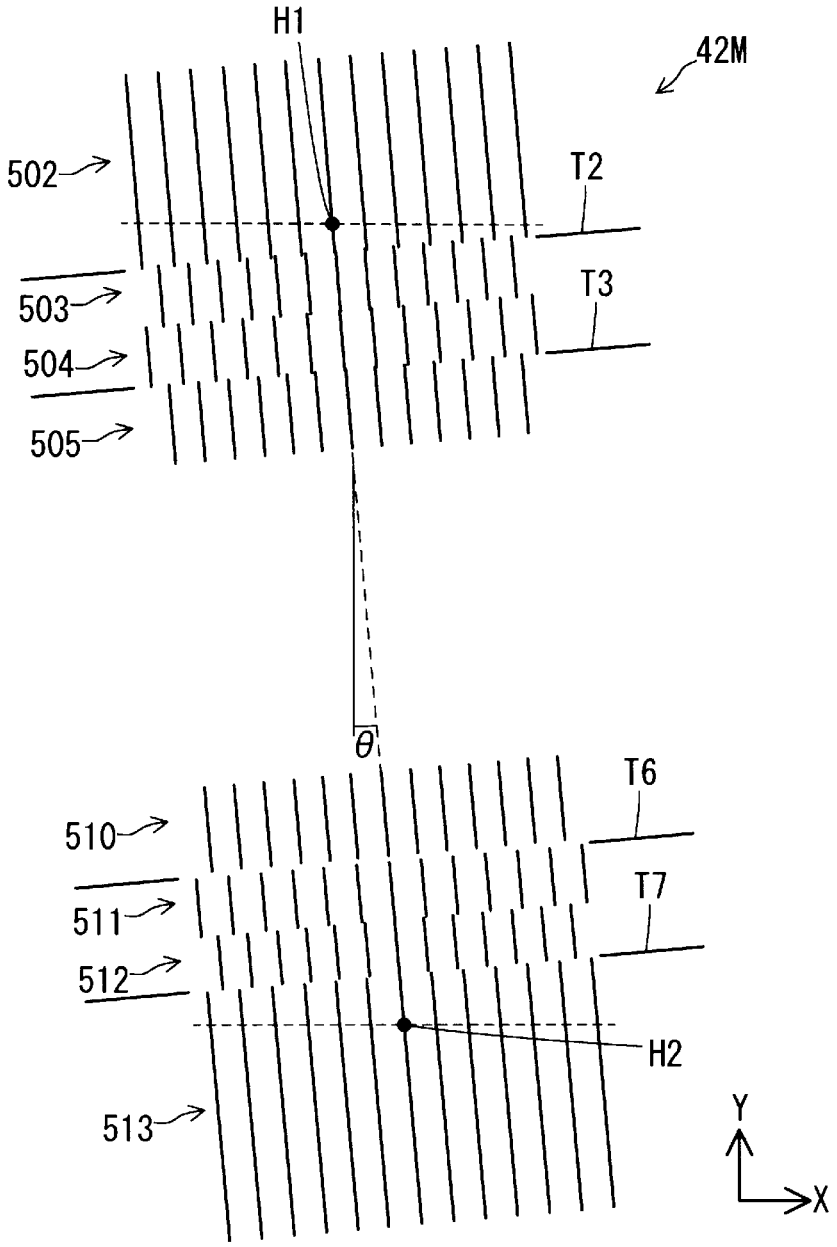
FIG. 13 is a diagram illustrating a test pattern created in the case where yaw has been generated.

FIG. 13 illustrates the region 42M in the case where yaw has been generated. In the region 42M illustrated in FIG. 13, it is assumed that displacement other than yaw has not been generated. In the case where displacement of yaw has been generated, the region 42M rotates about the Z direction as a whole.

Parts illustrated in FIG. 13 are grouped such that two of them are provided for each of the four forming methods determined according to whether the nozzle column A or the nozzle column B is selected, and whether the forward pass or the reverse pass is selected. For example, both of the second part 502 and the thirteenth part 513 are formed of the nozzle column A and the forward pass. In the present embodiment, the test pattern 40 is designed such that ruled lines included in parts based on the same forming method are formed at the same positions in terms of the X direction. In other words, the detection positions for the corresponding ruled lines are the same. The corresponding ruled lines mean ruled lines having the same position (hereinafter array position) in the X direction in the array such as ruled lines located on the most positive side in the X direction or ruled lines located at the center in the X direction.

In the case where the displacement of yaw is generated, ruled lines contained in the parts based on the same forming method show an angle which is the same as the rotation angle of the yaw, when measured using the corresponding ruled lines and when displacement other than yaw has not been generated.

In FIG. 13, an angle θ is shown as a measurement result of a rotation angle measured using the middle ruled line. The angle θ is an angle formed by the Y direction and a predetermined line segment. The predetermined line segment is a line segment connecting a detection position H1 of the second part 502 to a detection point H2 of the thirteenth part 513.

Note that when displacement other than yaw has not been generated, a ruled line at any array position may be used as the corresponding ruled line since the same angle is obtained. When displacement other than yaw has not been generated, the same angle is obtained by using any part based on one method among four forming methods, i.e., the nozzle column A or the nozzle column B, a forward pass or a reverse pass. When this rotation angle is grasped, the computation of the amount of displacement due to yaw becomes possible.

Figure 14:
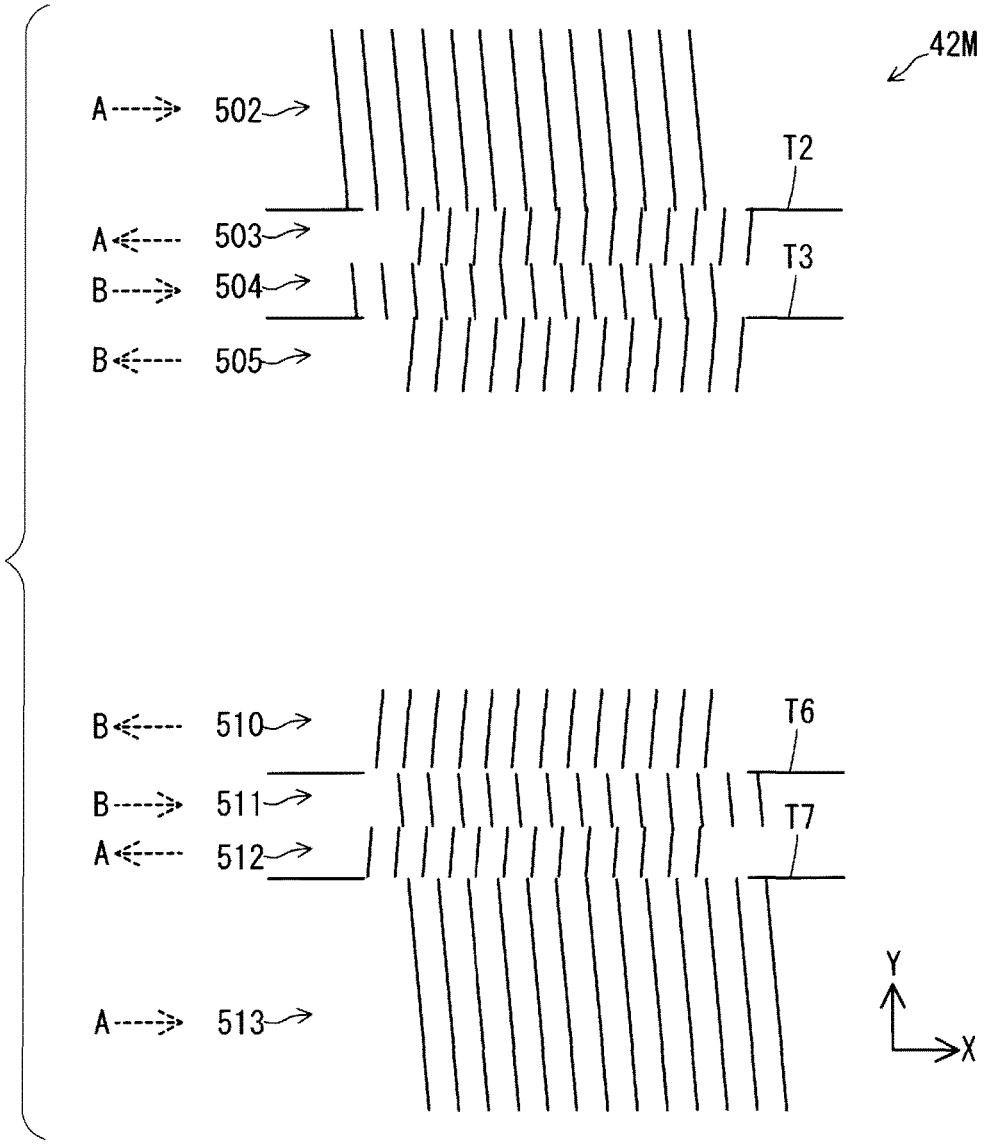
FIG. 14 is a diagram illustrating a test pattern created in the case where roll has been generated.

FIG. 14 illustrates the region 42M created in the case where roll has been generated. In the region 42M illustrated in FIG. 14, it is assumed that displacement other than roll has not been generated. Although displacement is generated at the position of a crossmark also due to roll displacement, it is assumed that the location of the crossmark is not displaced in the illustration of FIG. 14, similarly to FIG. 12.

In the case where roll displacement is generated, any part rotates about the Z direction. However, the rotation direction of parts formed on the forward pass is opposite to that of parts formed on the reverse pass.

When FIG. 12 is compared with FIG. 14, similar displacements are generated on the two sides of the crossmarks T2 and T3, according to measurement. Hence, in the case where only the two sides of the crossmarks T2 and T3 are used, it is difficult to distinguish between round-trip displacement and roll displacement. On the other hand, when the two sides of the crossmarks T6 and T7 are compared, displacement relationships are reversed. Hence, round-trip displacement and roll displacement can be separated from each other by using both the two sides of the crossmarks T2 and T3 and the two sides of the crossmarks T6 and T7.

By using the relationship described above, even under the assumption that all of round-trip displacement, yaw displacement, and roll displacement may be generated, each of the three displacements can be obtained by using the detection positions on the two sides of each of the crossmarks T2, T3, T6, and T7.

Next, the amount of impact displacement is computed (step S240). In step S240, all of the chip displacement, round-trip displacement, column displacement, head displacement, yaw displacement, and roll displacement of each of the nozzle columns A and B are obtained.

Next, it is determined whether or not all have been detected (step S250). In other words, it is determined whether or not the computation of the amount of impact displacement for each of the 24 locations described above has been finished.

In the case where the detection has not been finished, (No in step S250), steps S210 to S240 are appropriately repeated. When all have been detected (Yes in step S250), processing for measuring the amount of impact displacement ends.

When processing for measuring the amount of impact displacement is finished, correction computation for the amount of impact displacement is performed (step S290), and the correction processing ends. When the correction processing is finished, dot formation processing is performed (step S300).

Figure 15:
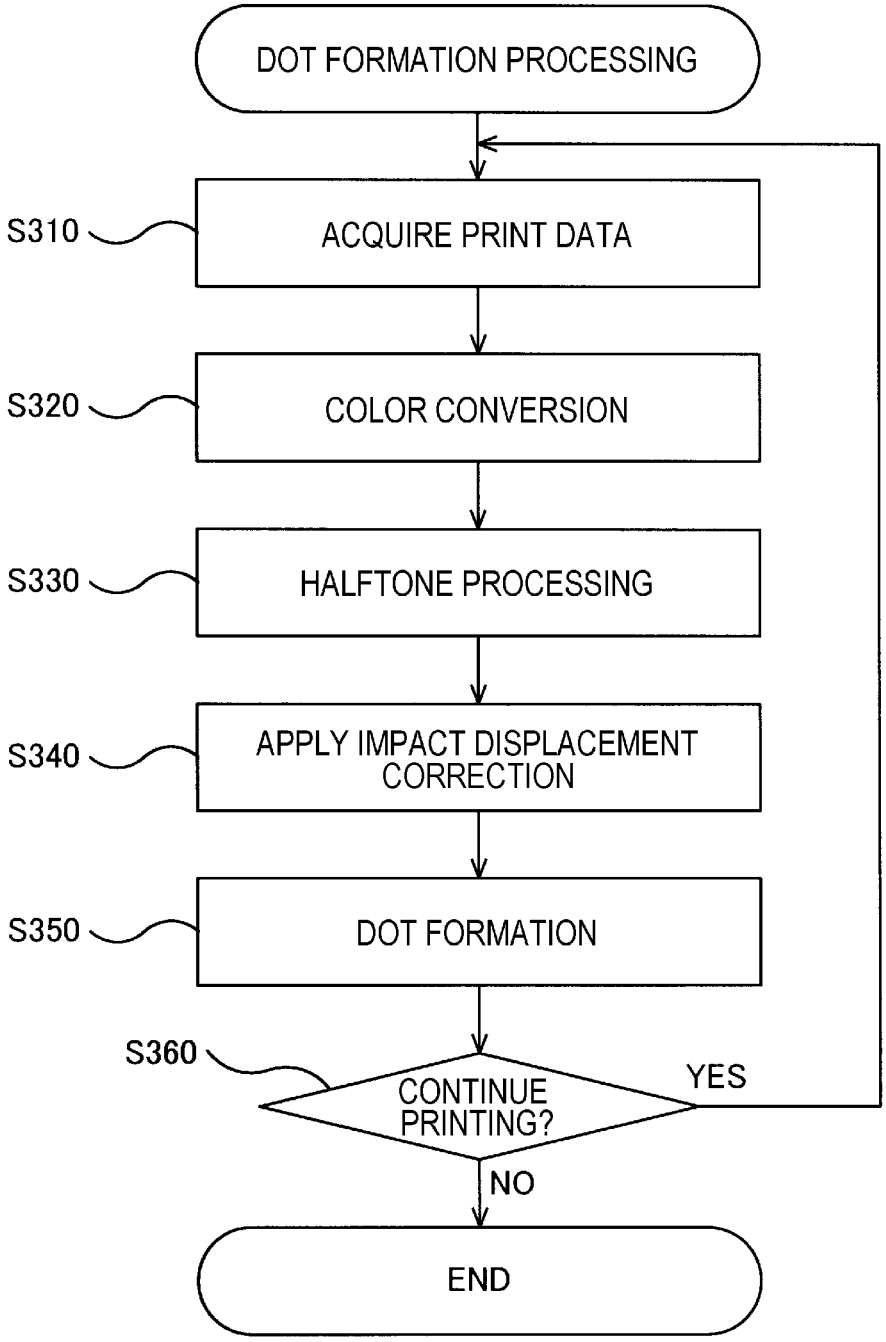
FIG. 15 is a flowchart illustrating dot formation processing.

FIG. 15 is a flowchart illustrating the dot formation processing. First, print data to be printed is acquired (step S310). Next, color conversion is performed (step S320). In other words, print data represented in RGB is converted to ink values based on CMYKLcLm color representation. Next, halftone processing is performed (step S330).

Next, the amount of impact displacement is applied (step S340). In other words, dot data obtained by halftone processing is modified by using the amount of impact displacement stored in step S290.

Next, dots are formed using the modified dot data (step S350). When dot formation based on the print data acquired in step S310 is finished, it is determined whether or not printing is to be terminated (step S360). In the case where printing is continued (Yes in step S360), the processing flow goes back to step S310. In the case where printing is terminated (No in step S360), dot formation processing is terminated. In accordance with this, print processing is terminated.

According to the embodiment described above, six types of impact displacement are detected and printing can be performed while compensating for the impact displacement. The test pattern 40, which is created by single-round-trip main scanning, can be created in a short time and requires only a small area of the print medium MD.

The present invention is not limited to the embodiments, examples, or modifications described above, and can be realized using various other configurations. For example, technological features in the embodiments, examples, and modifications described in Summary section above can be appropriately replaced or combined to achieve a portion or the whole of the effects described above. The technological features, unless described as essential in the present disclosure, can be appropriately deleted. For example, the following is illustrated.

The test pattern need only include a region for detecting at least three displacements. For example, the test pattern may be formed of three parts, i.e., a part for detecting roll displacement, a part for detecting yaw displacement, and a part for detecting head displacement. Although displacements of roll and yaw are detected using a part that detects round-trip displacement, it is not essential that a part that detects round-trip displacement is included. In other words, if round-trip displacement is detected separately, it is not necessary to detect round-trip displacement using the test pattern of the present application, and the test pattern may be utilized as a part for detecting displacement of roll and yaw.

Ink colors used to create a test pattern may include any number of colors, and a single color may be used, for example.

In the embodiments above, a case was illustrated in which the nozzle column A and the nozzle column B are each oriented in the sub-scanning direction (that is, in a direction orthogonal to the main scanning direction). However, at least one of the nozzle column A and the nozzle column B need not be oriented in the sub-scanning direction.

The directions of the forward pass and reverse pass in the main scanning may be opposite to those illustrated in the embodiment.

In the above-described embodiments, part or the whole of functions and processing implemented in software may be implemented in hardware. Similarly, part or the whole of functions and processing implemented in hardware may be implemented in software. Examples of hardware that can be used include various types of circuits such as integrated circuits, discrete circuits, or a circuit module in which they are combined.

What is claimed is:

1. A method of creating a test pattern including a plurality of ruled lines for measuring impact displacement in a main scanning direction, the method comprising:

providing a printing apparatus comprising:

a plurality of print heads comprising a first print head configured to eject ink of a first ink color, and a second print head configured to eject ink of a second ink color, wherein the first print head comprises a first print chip and a second print chip, wherein the first print chip comprises a plurality of nozzles that form a first nozzle column and a second nozzle column, the first nozzle column being arranged in an intersecting direction that intersects with the main scanning direction, the second nozzle column being located to a predetermined side of the first nozzle column in the main scanning direction, creating the test pattern such that the test pattern comprises at least three parts arranged in a sub-scanning direction of the printing apparatus, the sub-scanning direction intersecting the main scanning direction, the at least three parts being selected from the group consisting of:

a part for measuring impact displacement due to head displacement of the first print head and the second print head, a part for measuring impact displacement due to chip displacement of the first print chip and the second print chip, a part for measuring impact displacement due to round-trip displacement including forward-pass displacement and reverse-pass displacement in main scanning, a part for measuring impact displacement due to column displacement of the first nozzle column and the second nozzle column, a part for measuring impact displacement due to position displacement of the first print head with respect to a direction of rotation about the main scanning direction, and a part for measuring impact displacement due to position displacement of the first print head with respect to a direction of rotation about a direction orthogonal to the main scanning direction and the intersecting direction, wherein a length of the test pattern in the sub-scanning direction is less than or equal to an overall length of the first print head and the second print head the sub-scanning direction.

2. The method of creating a test pattern according to claim 1, wherein the second print head comprises a third print chip, wherein the third print chip comprises a plurality of nozzles forming a third nozzle column arranged in the intersecting direction and a fourth nozzle column located to the predetermined side of the third nozzle column in the main scanning direction, wherein the first nozzle column is arranged to form dots within a range, in the intersecting direction, that is at least partially superposed with a range in the intersecting direction within which the third nozzle column is arranged to form dots, wherein the test pattern includes the part for measuring impact displacement due to head displacement of the first print head and the second print head, and wherein the part for measuring impact displacement due to head displacement of the first print head and the second print head is formed using the first nozzle column and the third nozzle column during main scans in the same direction.

3. The method of creating a test pattern according to claim 1, wherein the second print chip comprises a plurality of nozzles forming a third nozzle column and a fourth nozzle column, wherein the test pattern includes the part for measuring impact displacement due to chip displacement of the first print chip and the second print chip, and wherein the part for measuring the impact displacement due to chip displacement of the first print chip and the second print chip is formed using the first nozzle column included in the first print chip and the third nozzle column included in the second print chip during main scans in the same direction.

4. The method of creating a test pattern according to claim 1, wherein the test pattern includes the part for measuring impact displacement due to column displacement of the first nozzle column and the second nozzle column, and wherein the part for measuring the impact displacement due to column displacement of the first nozzle column and the second nozzle column is formed using the first nozzle column and the second nozzle column of the first print chip during main scans in the same direction.

5. The method of creating a test pattern according to claim 1, wherein the test pattern includes the part for measuring impact displacement due to round-trip displacement, and wherein the part for measuring the impact displacement due to round-trip displacement is formed using the first nozzle of the first print chip during main scanning in a forward pass and in a reverse pass.

6. The method of creating a test pattern according to claim 5, wherein the test pattern includes the part for measuring impact displacement due to position displacement in the direction of rotation about the direction orthogonal to the main scanning direction and the intersecting direction, and wherein the part for measuring the impact displacement due to position displacement in the direction of rotation about the direction orthogonal to the main scanning direction and the intersecting direction is formed at two different locations in the intersecting direction.

7. The method of creating a test pattern according to claim 5, wherein the test pattern includes the part for measuring impact displacement due to position displacement in the direction of rotation about the main scanning direction, and wherein the part for measuring the impact displacement due to position displacement in the direction of rotation about the main scanning direction is formed at two different locations in the intersecting direction.

8. The method of creating a test pattern according to claim 1, wherein the test pattern is created by less than or equal to two main scans.

9. A printing apparatus comprising:

a plurality of print heads comprising a first print head configured to eject ink of a first ink color; and a second print head configured to eject ink of a second ink color, wherein the first print head comprises first and second print chips, wherein the first print chip comprises a plurality of nozzles forming a first nozzle column arranged in an interesting direction intersecting with a main scanning direction and a second nozzle column arranged on a predetermined side of the first nozzle column in the main scanning direction, wherein the printing apparatus is configure to create a test pattern including a plurality of ruled lines for measuring an impact displacement in the main scanning direction, wherein the test pattern comprises at least three parts arranged in a sub-scanning direction of the printing apparatus, the at least three parts being selected from the group consisting of:

a part for measuring an impact displacement due to head displacement of the first print head and the second print head, a part for measuring an impact displacement due to chip displacement of the first print chip and the second print chip, a part for measuring an impact displacement due to round-trip displacement including forward-pass and reverse-pass displacement in main scanning, a part for measuring an impact displacement due to column displacement of the first nozzle column and the second nozzle column, a part for measuring an impact displacement due to position displacement of the first print head with respect to a direction of rotation about the main scanning direction, and a part for measuring an impact displacement due to position displacement of the first print head with respect to a direction of rotation about a direction orthogonal to the main scanning direction and the intersecting direction, wherein a length of the test pattern in the sub-scanning direction is less than or equal to an overall length of the plurality of print heads in the sub-scanning direction.

10. A non-transient computer-readable medium comprising a program for causing a printing apparatus to create a test pattern including a plurality of ruled lines for measuring, using main scanning, an impact displacement with respect to a main scanning direction, the printing apparatus comprising a plurality of print heads comprising a first print head configured to eject ink of a first ink color and a second print head configured to eject ink of a second ink color, the first print head comprising first and second print chips, and the first print chip comprising a plurality of nozzles forming a first nozzle column arranged in an intersecting direction intersecting with the main scanning direction and a second nozzle column located on a predetermined side of the first nozzle column in the main scanning direction, the program creating the test pattern such that the test pattern comprises at least three parts arranged in a sub-scanning direction of the printing apparatus, the at least three parts being selected from the group consisting of:

a part for measuring an impact displacement due to head displacement of the first print head and the second print head, a part for measuring an impact displacement due to chip displacement of the first print chip and the second print chip, a part for measuring an impact displacement due to round-trip displacement including forward-pass and reverse-pass displacement in main scanning, a part for measuring an impact displacement due to column displacement of the first nozzle column and the second nozzle column, a part for measuring an impact displacement due to position displacement of the first print head with respect to a direction of rotation about the main scanning direction, and a part for measuring an impact displacement due to position displacement of the first print head with respect to a direction of rotation about a direction orthogonal to the main scanning direction and the intersecting direction, wherein a length of the test pattern in the sub-scanning direction is less than or equal to an overall length of the plurality of print heads in the sub-scanning direction.

* * * * *